US005827048A

United States Patent [19]

Tonegawa et al.

[11] Patent Number: 5,827,048

[45] Date of Patent: Oct. 27, 1998

[54] GETTER SUPPORT

[75] Inventors: Takeshi Tonegawa; Akira Kadowaki; Gentaro Tanaka; Shigeo Itoh; Yuuichi Kogure, all of Mobara, Japan

[73] Assignee: Futaba Denshi Kogyo K.K., Mobara, Japan

[21] Appl. No.: 739,293

[22] Filed: Oct. 29, 1996

[30] Foreign Application Priority Data

Oct. 31, 1995 [JP] Japan ..... 7-283451

[51] Int. Cl.[6] ..... H01J 9/39

[52] U.S. Cl. ..... 417/48; 445/31

[58] Field of Search ..... 445/31, 41; 417/48

[56] References Cited

U.S. PATENT DOCUMENTS 2,668,253 2/1954 Taylor ..... 417/48

4,535,267 8/1985 Martelli et al. ..... 417/48 X

*Primary Examiner*—Kenneth J. Ramsey

*Attorney, Agent, or Firm*—Oblon, Spivak, McClelland, Maier & Neustadt, P.C.

[57] ABSTRACT

A getter support capable of permitting a getter to be compactly arranged in a vacuum envelope while keeping a space for the getter minimized. The getter support includes holders for vertically interposedly holding a getter, first support legs formed integrally with the holders so as to downwardly extend therefrom, and second support legs formed integrally with the holders so as to upwardly extend therefrom. The getter support is fixedly arranged in a getter chamber while being pressed by elasticity of the second support legs. The second support legs are varied in deflection depending on contact thereof with a second substrate of an envelope. This permits a distance between an upper surface of the getter and the second substrate of the envelope to be constantly kept at a desired value.

2 Claims, 6 Drawing Sheets

GETTER SUPPORT

BACKGROUND OF THE INVENTION

This invention relates to a getter support for a vacuum envelope, and more particularly to a getter support for holding a getter in a vacuum envelope such as an envelope for a fluorescent display device or the like.

A fluorescent display device, as shown in FIG. 9, generally includes a box-like envelope 100 constructed of a combination of insulating members made of an insulating material such as glass or the like. The envelope 100 commonly used for such a purpose includes a casing 102 of a substantially box-like shape of which a lower end is open and an anode substrate 101 of which an upper surface is mounted on the open lower end of the casing 102. The casing 102 and anode substrate 101 are then sealedly joined to each other by means of a sealing material, resulting in the envelope 100 being provided. The envelope 100 thus formed is then evacuated to a high vacuum, in which electrodes such as anodes each deposited thereon with a phosphor layer acting as a luminous section, filamentary cathodes acting as an electron source and the like are arranged on the anode substrate 101. The filamentary cathodes 103 are fixed at one end thereof on cathode supports 105 mounted on a spacer frame 104 and at the other end thereof on opposite cathode supports (not shown) constructed so as to exhibit elasticity. The spacer frame 104 which is arranged so as to extend through the envelope 100 is then outwardly led out of a sealed portion of the envelope 100 while ensuring airtightness between the spacer frame 104 and the sealed portion. The envelope 100 is used at a part of a portion thereof led out of the envelope 100 as an external lead terminal.

The fluorescent display device also includes a getter 1, which is arranged above the spacer frame 104 in the envelope 100. More particularly, the getter 1 is mounted on the spacer frame 104 through a metal member 106 fixed on the spacer frame 104 in a manner to upwardly extend therefrom. The getter 1, as shown in FIG. 8, includes an annular frame 2 made of a metal material and plated with nickel, as well as a getter material 3 of powder-like alloy such as $BaAl_4$ or the like charged in the frame 2. In the fluorescent display device thus constructed, the envelope 100 is evacuated to a high vacuum and then sealed to keep an interior of the envelope at a high vacuum. Then, the getter material 3 is heated by high frequency induction, resulting in evaporated or vaporized. This permits a Ba deposition film to be formed on an inner surface of the envelope 100, which film functions to adsorb thereon any gas remaining in the envelope 100, to thereby keep the interior of the envelope at a vacuum of a predetermined level.

Unfortunately, the above-described structure for mounting or holding the getter 1 in the envelope 100 wherein the getter 1 is held above the spacer frame 104 by means of the metal member 106 raised from the spacer frame 104 requires a space corresponding to a thickness of the getter 1 and a height of the metal member 106, to thereby fail to reduce a thickness or height of the envelope 100 to a value smaller than a vertical dimension of the space. Thus, the prior art fails in formation of the envelope into a reduced thickness.

A field-emission type fluorescent display device which is a fluorescent display device having field emission cathodes incorporated therein as an electron source thereof permits a space between cathodes and anodes to be minimized, to thereby accomplish thinning of an envelope. However, such a thinned envelope fails to permit the getter to be incorporated therein. One of approaches to the problem is that a getter chamber is arranged outside the envelope so as to communicate with the envelope, in which the getter is received. However, the approach causes the getter chamber to be still increased in thickness or height unless the getter holding structure is improved, resulting in failing to put the advantage of the field emission type fluorescent display device to practical use.

SUMMARY OF THE INVENTION

The present invention has been made in view of the foregoing disadvantage of the prior art.

Accordingly, it is an object of the present invention to provide a getter support which is capable of permitting a getter to be compactly arranged in a vacuum envelope such as an envelope for a fluorescent display device or the like while keeping a space for the getter minimized.

In accordance with the present invention, a getter support for supporting a getter of an annular shape in a vacuum envelope is provided. The getter support includes a holding section for holding the getter thereon, first support legs provided on the holding section in a manner to downwardly extend therefrom, and second support legs provided on the holding section in a manner to upwardly extend therefrom. The second support legs each are formed so as to exhibit elasticity.

In a preferred embodiment of the present invention, the holding section includes a base formed into an annular shape and a plurality of holders arranged on the base so as to be spaced from each other at predetermined angular intervals in a circumferential direction of the base.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 3(*b*) is a schematic plan view of the getter support shown in FIG. 3(*a*);

FIG. 3(*c*) is a schematic side view of the getter support shown in FIG. 3(*a*);

FIG. 5(*b*) is a side view of the getter support shown in FIG. 5(*a*);

FIG. 8(*b*) is a sectional view taken along line 8(*b*)—8(*b*) of FIG. 8(*a*)

DETAILED DESCRIPTION OF THE PREFERRED EMBODIMENTS

Now, a getter support according to the present invention will be described hereinafter with reference to FIGS. 1 to 7.

Figure 1:
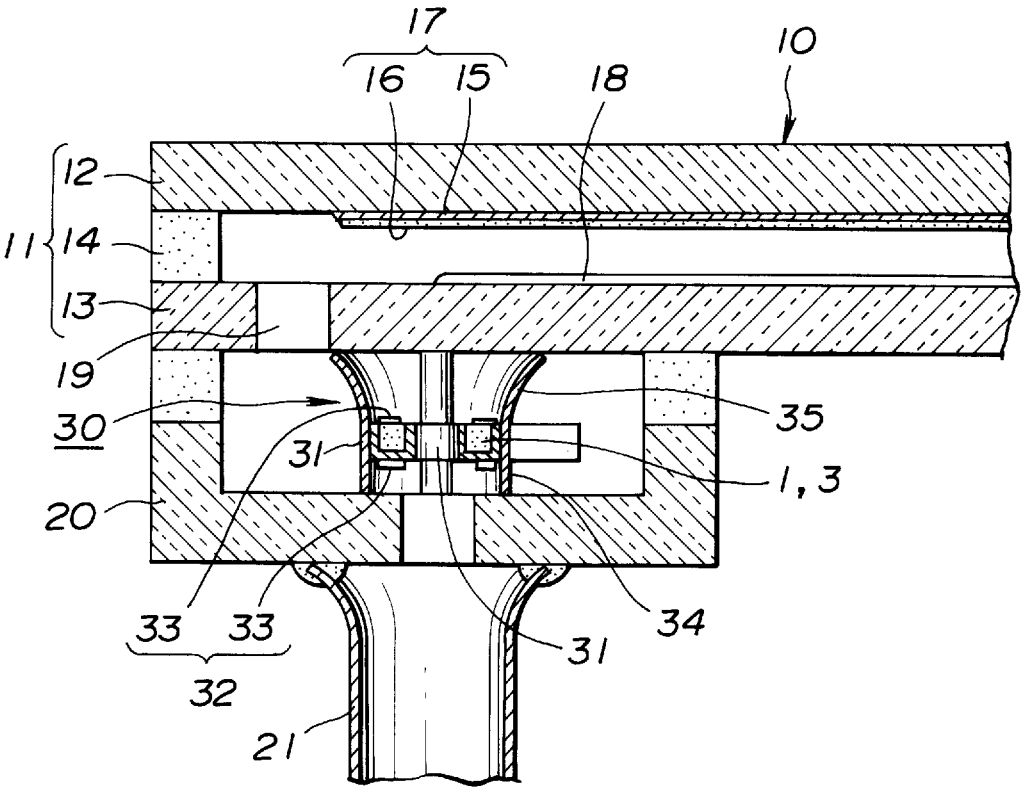
FIG. 1 is a fragmentary sectional view showing an essential part of a field emission type fluorescent display device in which an embodiment of a getter support according to the present invention is incorporated.

Referring first to FIGS. 1 to 4, a first embodiment of a getter support according to the present invention is illustrated. In FIG. 1, reference numeral 10 designates a field emission type fluorescent display device (hereinafter also referred to as "display device") which has field emission cathodes acting as an electron source incorporated therein. The display device 10 includes an envelope 11, which includes a first substrate 12 constituting a front cover of the envelope 10, a second substrate 13 constituting a rear plate thereof and arranged so as to be spaced from the first substrate 12 at a microdistance and opposite to the first substrate 12, and a spacer 14 arranged between an outer periphery of the first substrate 12 and that of the second substrate 13 so as to form a side plate of the envelope 10. The spacer 14 may be made of a sealing glass material or the like. The first and second substrates 12 and 13 are made of an insulating material such as glass or the like. The first substrate 12 is formed on an inner surface thereof with anodes 17 each constructed of a light-permeable anode conductor 15 and a phosphor layer 16 deposited on the anode conductor 15. The second substrate 13 is formed on an inner surface thereof with field emission cathodes 18. The field emission cathodes 18 each include an emitter and a gate, wherein an electric field generated by the gate permits electrons emitted from the emitter to be impinged on the phosphor layer 16 of the anode 17 acting as a collector, leading to luminescence of the phosphor layer 16.

Reference numeral 20 designates a getter chamber provided outside the envelope 11 of the display device. The getter chamber 20 is defined by walls of an insulating material such as glass and constructed so as to communicate with an interior of the envelope 11 via a vent hole 19 formed through any wall of the envelope 11. In the illustrated embodiment, the vent hole 19 is formed through the second substrate 12. The getter chamber 20 has an evacuation tube 21 connected thereto, so that the getter chamber 20 is permitted to communicate with an ambient atmosphere through the evacuation tube 21. Assembling of the envelope 11 with the getter chamber 20 and evacuation tube 21 may be carried out by means of sealing glass or the like. During evacuation, the interior of the envelope 11 is evacuated through the evacuation tube 21 and getter chamber 20. Then, the evacuation tube 21 is sealedly closed.

Figure 8B:
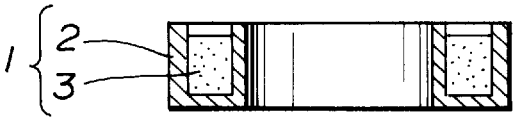
FIG. 8(*a*) is a plan view showing a getter.
Figure 8A:
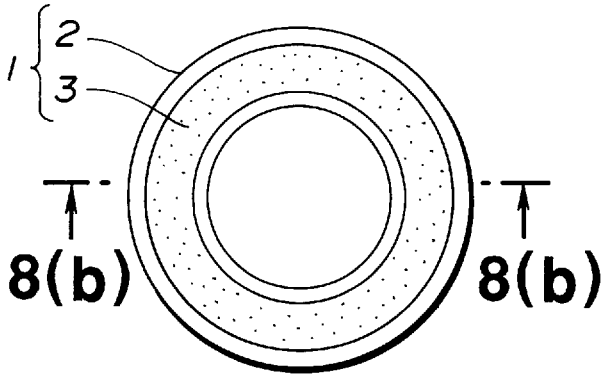
Figure 9:
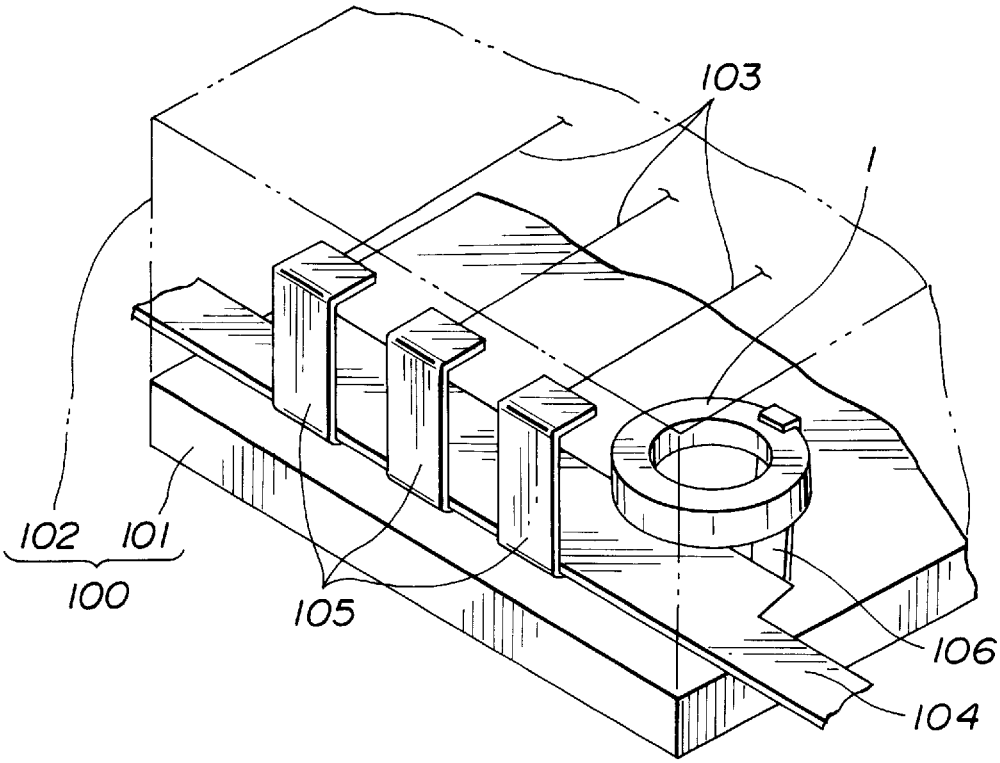
FIG.9 (PRIOR ART)
FIG. 9 is a fragmentary perspective view showing an essential part of a fluorescent display device in which a conventional getter support structure is incorporated.

The getter chamber 20 is provided therein with a getter 1 of an annular shape and a getter support 30 for supporting the getter 1 thereon. The getter 1 may be constructed in such a manner as described above with reference to FIGS. 8(*a*) and 8(*b*). The getter support 30 includes a strip-like base 31 formed into an annular shape so as to surround an outer periphery of the getter 1. The base 31 is provided thereon with at least one holder 32. In the illustrated embodiment, three such holders 32 are provided on the base 31 in a manner to be integral therewith and arranged so as to be spaced from each other at angular intervals of about 120 degrees in a circumferential direction of the base 31. The holders 32 each are constructed of a pair of holding elements 33 arranged so as to be spaced from each other in a vertical direction and formed so as to extend inwardly of the base 31. The getter 1 is supported or held between the holding elements 33 in three pairs each arranged so as to be vertically spaced from each other. Also, the base 31 is provided thereon with first support legs 34 so as to downwardly extend from the base 31 or a lower surface of a frame 2 of the getter 1. Further, the base 31 is provided thereon with second support legs 35 so as to exhibit elasticity and in a manner to upwardly extend from the base 31 and be upwardly outwardly enlarged. The first and second support legs 34 and 35 are arranged on the base 31 so as to be positionally aligned with each other. In the illustrated embodiment, three such first support legs 34 and three such second support legs 35 are arranged so as to be spaced from each other at angular intervals of about 120 degrees, respectively.

Figure 2:
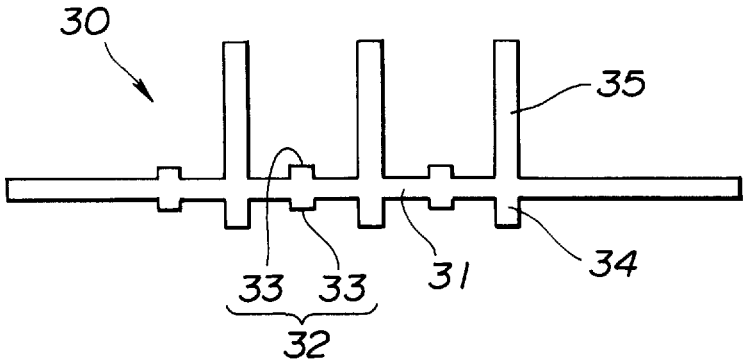
FIG. 2 is a front elevation view of the getter support shown in FIG. 1 before machining or working.

Now, the manner of manufacturing of the getter support 30 and that of mounting of the getter support 30 on the getter 1 will be described hereinafter. The getter support 30 before shaping or working takes such a configuration as shown in FIG. 2. In the illustrated embodiment, the getter support 30 shown in FIG. 2 may be formed of stainless steel of 0.05 mm in thickness by punching or blanking. The getter support 30 before shaping includes the base 31 having a length larger than a circumference of the getter 1, the holding elements 33 in pairs formed in a manner to be integral with the base 31 so as to constitute the holders 32, the first support legs 34 formed integrally with the base 31, and the second support legs 35 formed integrally with the base 31.

Figure 3:
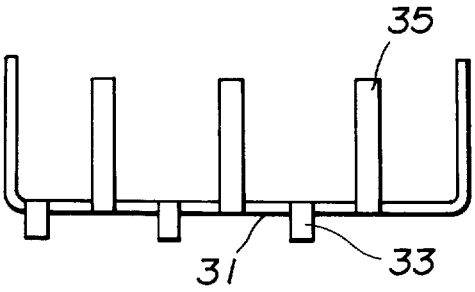
FIG. 3(*a*) is a schematic front elevation view of the getter support shown in FIG. 1, which is under working.
Figure 3:
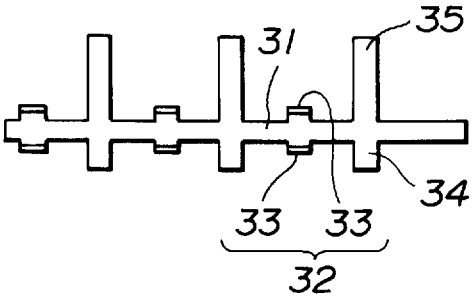
Figure 3:
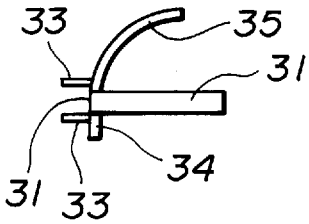
Figure 4:
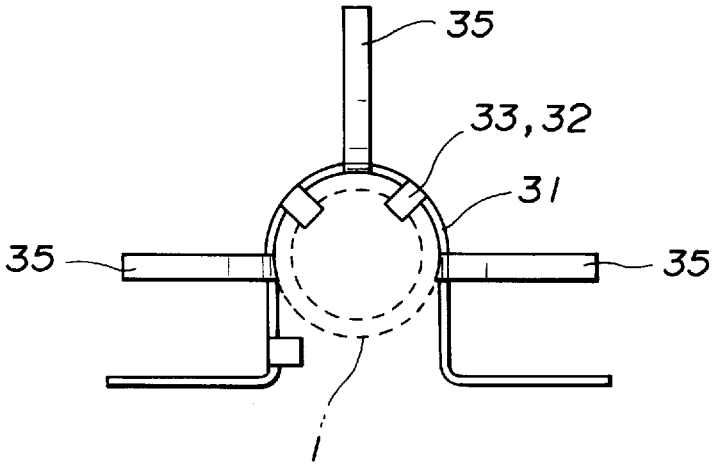
FIG. 4 is a schematic view of the getter support shown in FIG. 1, which is under working.

Then, as shown in FIGS. 3(*a*) to 3(*c*), the holding elements 33 are inwardly bent so as to be rendered perpendicular to the base 31 and then the second support legs 35 are outwardly curvedly bent. Subsequently, as shown in FIG. 4, the getter support 30 is wound around the getter 1 while abutting an inner surface of the base 31 against an outer periphery of the getter 1, so that the getter 1 may be vertically interposedly held between the holding elements 33 in each pair. Thereafter, the base 31 is overlapped at both ends thereof to each other and then fixed to each other by twisting or welding. The welded portion of the base 31 may be left or removed.

Subsequently, the getter 1 mounted on the getter support 30 is put in the getter chamber 20 while keeping an upper surface of the getter 1 from which a getter material is discharged facing a surface of the envelope on which a getter film is to be formed. In the illustrated embodiment, the getter film is formed on an outer surface of the second substrate 13 of the envelope 11. For this purpose, the first support legs 34 are abutted against an inner surface of a wall of the getter chamber 20 to which the exhaust tube 21 is connected and the second support legs 35 are abutted against the outer surface of the second substrate 13.

The getter 1 is positively held on the three holders 32 of the getter support 30, resulting in being effectively prevented from being removed or detached therefrom. Thus, the getter support 30 is set at a predetermined position on the wall of the getter chamber 20 by means of the first support legs 34 and pressedly fixed in the getter chamber 20 by elastic force of the second support legs 35. This results in the getter set once being prevented from displaced in a horizontal direction. Also, the second support legs 35 are varied in deflection thereof depending on a degree of contact thereof with the second substrate 13 of the envelope 11. This permits a distance between the upper surface of the getter 1 and the second substrate 13 of the envelope 11 to be kept constant, so that the getter film may be formed in a desired area on the second substrate 13. Thus, for example, even when the sealing glass used for sealing of the envelope 11 adheres to the outer surface of the second substrate 13 of the envelope 11 to form any protrusion thereon, to thereby cause the second support legs 35 to be contacted with the protrusion; the second support legs 35 deflect depending on the protrusion, to thereby substantially prevent the getter 1 supported on the getter support 30 from being displaced in a vertical direction, so that a distance between the getter 1 and the second substrate 13 may be kept at a desired value.

After the getter 1 is thus arranged in the getter chamber 20 through the getter support 30, the envelope 11 is subject to evacuation and sealing, followed by heating of the getter 1 by high frequency induction. This results in the getter material 3 being evaporated or vaporized, followed by deposition of the vaporized material on the outer surface of the second substrate 13 for forming a getter film thereon. The second substrate 13 is kept at a suitable or desired distance from the getter 1, so that the getter film may be formed into a desired area.

During heating of the getter 1 by high frequency induction, the getter 1 is heated to a temperature as high as 1000° to 1200° C. Thus, when the getter 1 is kept contacted with the envelope 11 or getter chamber 20 even partially or connected to the envelope 11 in an increased area through any parts made of a material increased in heat conductivity, there would be a likelihood that the envelope 11 or getter chamber 20 is damaged or broken due to heat of the getter. The illustrated embodiment effectively eliminates such a disadvantage. More particularly, in the illustrated embodiment, the first and second support legs 34 and 35 for supporting the getter 1 in the getter chamber 20 each are formed into a thin strip-like shape, resulting in being kept contacted with the envelope 11 and getter chamber 20 in a manner like point-contact, to thereby minimize thermal conduction between the support legs and the envelope 11 or getter chamber 20, so that damage to the envelope 11 and the like due to heat generated from the getter 1 may be minimized or substantially prevented.

In the illustrated embodiment, the getter support 30 may be so constructed that the holders 32, first support legs 34 and second support legs 35 are made separately from each other, followed by integral assembling of such members by welding or the like. However, such formation of the getter support by blanking and bending of sheet metal as described above facilitates manufacturing of the getter support and reduces a manufacturing cost thereof.

Figure 5B:
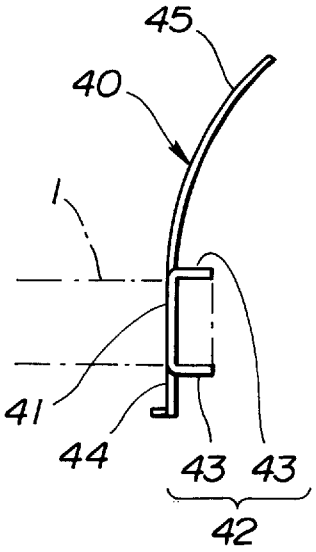
FIG. 5(*a*) is a schematic view showing another embodiment of a getter support according to the present invention, which is under working.
Figure 5A:
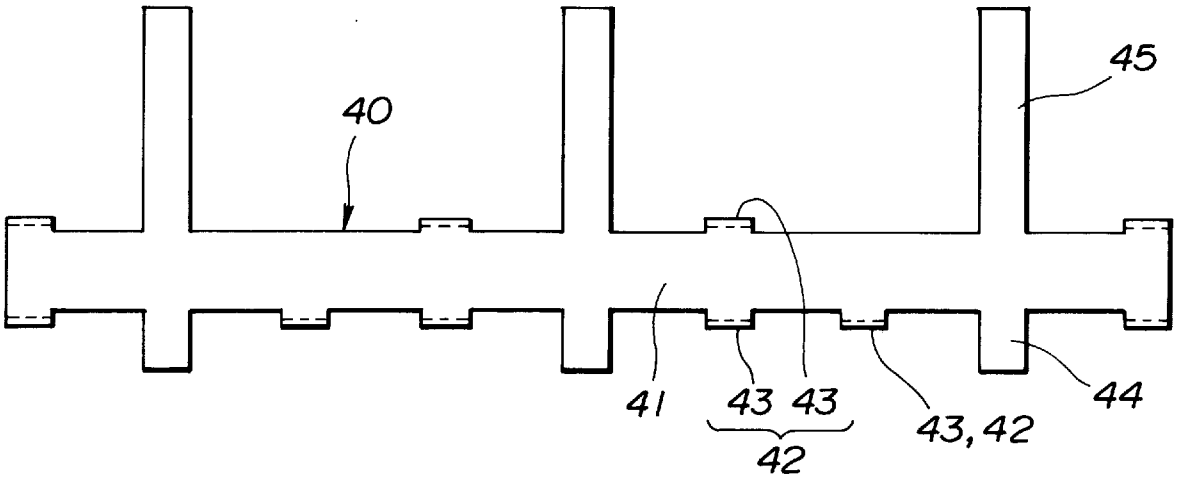
Figure 6:
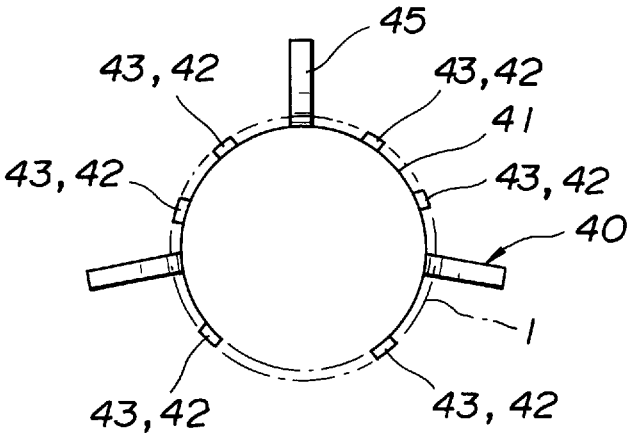
FIG. 6 is a plan view of the getter support shown in FIG. 5(*a*)

Referring now to FIGS. 5(*a*) to 7, a second embodiment of a getter support according to the present invention is illustrated. FIGS. 5(*a*) and 5(*b*) show a getter support 40 before shaping or working. The getter support 40 shown in FIGS. 5(*a*) and 5(*b*) includes a strip-like base 41 formed into substantially the same length as an inner peripheral length of an annular getter 1, holding elements 43 integrally provided on the base 41 so as to constitute holders 42, first support legs 44 integrally provided on the base 41, and second support legs 45 integrally provided on the base 41. In the illustrated embodiment, six such holders 42 are arranged, of which four each are constructed of holding elements 43 arranged in a pair in a vertical direction and two each are constructed of only a lower holding element 43. Then, the holding elements 43 for the holders 42 each are outwardly bent in a manner to be perpendicular to a surface of the base 41. The second support legs 45 are outwardly bent in a curved manner.

Then, the base 41 of the getter support 40, as shown in FIGS. 5(*b*) and 6, is rounded and then forcedly fitted in the getter 1, to thereby cause an outer surface of the base 41 to be abutted against an inner peripheral surface of the annular getter 1, followed by vertical holding of the getter 1 by means of the holders 42. The base 41 tends to outwardly expand due to its elasticity, thereby to be securely fitted in the getter 1, so that the getter may be positively held on the getter support 40.

Figure 7:
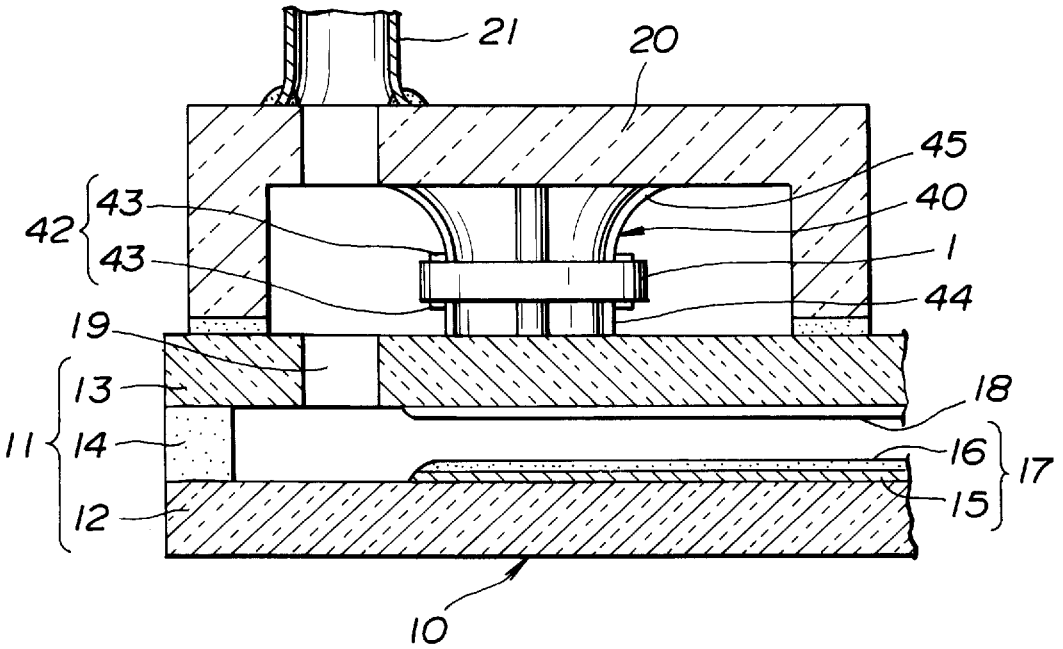
FIG. 7 is a fragmentary sectional view showing an essential part of a field emission type fluorescent display device in which the getter support shown in FIG. 5 is incorporated.

Subsequently, as shown in FIG. 7, the getter 1 thus mounted on the getter support 40 is positioned in a getter chamber 20. For this purpose, the first support legs 44 reduced in length are abutted against an outer surface of a second substrate 13 of an envelope 11. Then, the second support legs 45 outwardly curved so as to exhibit elasticity are abutted against an inner surface of a wall of the getter chamber 20 on a side of an evacuation tube 21. This results in an upper surface of the getter 1 from which a getter material 3 is discharged facing the above-described inner surface of the wall of getter chamber 20 on the side of the evacuation tube 21, so that a getter film may be formed on the inner surface. Thus, it will be noted that the second embodiment may exhibit substantially the same advantage as the first embodiment described above.

In each of the getter supports 30 and 40 of the embodiments described above, the second support legs 35 or 45 constructed so as to exhibit elasticity are arranged on a side of the surface of the getter 1 from which the getter material is discharged and the first support legs 34 or 44 each acting as a fixing leg are arranged on a side opposite to the side. Alternatively, the second support legs exhibiting elasticity may be arranged on the side opposite to that of the getter material discharge surface of the getter 1, so long as it is possible that a distance between the surface on which the getter film is to be formed and the getter is kept at a value sufficient to permit the getter film to be satisfactorily formed under desired conditions.

The getter support may be arranged in not only a getter chamber of a field emission type fluorescent display device but an envelope of a fluorescent display device of the conventional type having filamentary cathodes incorporated therein so as to act as an electron source. The conventional fluorescent display device, as described above, is typically constructed in such a manner that a getter is mounted on a spacer frame on which cathode supports are arranged. The getter support of the present invention permits the getter to be arranged at any other suitable position in the envelope.

As can be seen from the foregoing, the getter of the present invention is so constructed that the inner surface of the envelope or the like on which the getter is arranged is contacted with the support legs of the getter support in a manner like point-contact. This results in a contact area therebetween being reduced, to thereby substantially prevent damage to the glass envelope due to the getter heated to an elevated temperature.

Also, the getter is securely held in the envelope by a combination of the first support legs exhibiting rigidity and the second support legs exhibiting elasticity, so that a distance between the getter and the inner surface of the envelope may be kept constant. This permits the getter to generate an eddy current of a desired level, so that the getter material may be optimumly heated to a degree sufficient to form a desired getter film.

Further, the present invention permits the first and second support legs to be suitably adjusted to set a distance between the inner surface of the envelope and the getter as desired, so that an area of the getter film may be controlled as desired.

Moreover, the getter support of the present invention substantially prevents lateral displacement of the getter because the first support legs kept abutted against one of the inner surfaces of the envelope opposite to each other are kept stationary by elasticity of the second support legs kept abutted against the other inner surface of the envelope.

Furthermore, the getter support of the present invention may be arranged directly on the inner surface of the envelope made of glass or the like, to thereby eliminate a necessity of providing the envelope with any metal parts required for mounting by welding or the like.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A getter support for supporting a getter of an annular shape in a vacuum envelope, comprising:

a holding section for holding the getter thereon;

first support legs provided on said holding section in a manner to downwardly extend therefrom; and second support legs provided on said holding section in a manner to upwardly extend therefrom;

said second support legs each being formed so as to exhibit elasticity.

2. A getter support as defined in claim 1, wherein said holding section includes a base formed into an annular shape and a plurality of holders arranged on said base so as to be spaced from each other at predetermined angular intervals in a circumferential direction of said base.

* * * * *